US007326157B2

(12) United States Patent
Wu

(10) Patent No.: US 7,326,157 B2
(45) Date of Patent: Feb. 5, 2008

(54) EXERCISE DEVICE WITH STRETCHABLE ELASTIC MEMBER

(76) Inventor: Ying-Ching Wu, No. 25, Shin-Chi Village, Tainan County, An-Ding Shiang (TW)

( * ) Notice: Subject to any disclaimer, the term of this patent is extended or adjusted under 35 U.S.C. 154(b) by 137 days.

(21) Appl. No.: 11/307,113

(22) Filed: Jan. 24, 2006

(65) Prior Publication Data

US 2007/0173387 A1 Jul. 26, 2007

(51) Int. Cl.
*A63B 21/02* (2006.01)

(52) U.S. Cl. ..... 482/126; 482/121

(58) Field of Classification Search ..... 482/81, 482/121–130

See application file for complete search history.

(56) References Cited

U.S. PATENT DOCUMENTS

| | | | | |
|---|---|---|---|---|
| 1,524,108 | A | 1/1925 | Rowland | 24/129 R |
| 4,225,131 | A | 9/1980 | Sidlinger et al. | 272/109 |
| 4,733,862 | A | 3/1988 | Miller | 272/137 |
| 5,154,685 | A * | 10/1992 | Chen | 482/126 |
| 5,431,617 | A | 7/1995 | Rattray, Jr. | 482/129 |
| 5,556,368 | A | 9/1996 | Akin | 482/124 |
| 5,746,687 | A * | 5/1998 | Vial et al. | 482/126 |
| 5,885,196 | A * | 3/1999 | Gvoich | 482/125 |
| 6,402,668 | B1 * | 6/2002 | Harker | 482/121 |
| 6,497,641 | B1 | 12/2002 | Hinds | 482/126 |
| 6,500,105 | B1 | 12/2002 | Kuo | 482/123 |
| 6,648,804 | B2 * | 11/2003 | Chen | 482/125 |
| 6,676,576 | B1 | 1/2004 | Wu | 482/126 |
| 2005/0075223 | A1 | 4/2005 | Wu | 482/126 |
| 2005/0137066 | A1 | 6/2005 | Wu | 482/126 |

* cited by examiner

*Primary Examiner*—Stephen R. Crow
*Assistant Examiner*—Allana Lewin
(74) *Attorney, Agent, or Firm*—Alan Kamrath; Kamrath & Associates PA

(57) ABSTRACT

An exercise device includes an elastic member, a bar, and a handle coupled to an end of the elastic member. The bar includes an end having an engaging hole. The end of the bar further includes at least one longitudinal slot. The bar further includes at least one transverse slot extending from an inner end of the at least one longitudinal slot. The handle includes a grip portion and a connecting portion. The connecting portion includes at least one protrusion. The connecting portion of the handle is releasably coupled with the engaging hole of the end of the bar, with the at least one protrusion moving along the at least one longitudinal slot and the at least one transverse slot.

17 Claims, 6 Drawing Sheets

EXERCISE DEVICE WITH STRETCHABLE ELASTIC MEMBER

BACKGROUND OF THE INVENTION

1. Field of the Invention

The present invention relates to an exercise device. More specifically, the present invention relates to an exercise device with a stretchable elastic member.

2. Description of the Related Art

Exercise devices with stretchable elastic members allow exercising of selected muscles such as muscles of the chest and the arms. Some of the exercise devices with stretchable elastic members are lightweight and small in size to allow easy carriage. One type of the exercise devices with stretchable elastic members comprises a bar and an elastic member having two ends respectively attached to two ends of the bar. In use, the user positions an intermediate portion of the elastic member with one or both feet to retain the elastic member and grips the ends of the bar with both hands and repeatedly raises the bar to the chest or head level for exercising the muscles of the chest and the arms.

U.S. Pat. No. 6,402,668 discloses a slotted exercise apparatus of this type. The exercise apparatus comprises a bar member having two open ends, an elastic member, and two handles respectively attached to the open ends of the bar member. Each open end of the bar member is in communication with a cavity in the bar member. A slot is disposed in each end of the bar member and extends along a surface of the bar member to a length intermediate the two open ends and is in communication with the cavity. Each handle includes an engaging portion inserted into an associated open end and an associated slot. Each handle further includes an extending portion connected to the engaging portion and to the elastic member. The associated slot simultaneously receives the extending portion as the associated open end and the cavity receive the engaging portion. The extending portion extends through and from the associated slot forming a gap between the bar member and a section of the extending portion for gripping the bar member. A cap receives and covers each open end to thereby facilitate retention of the engaging portion of the associated handle within the cavity.

The exercise apparatus disclosed in U.S. Pat. No. 6,402,668 allows easy assembly and compact storage, as the elastic member and the handles are detachably mounted to the ends of the bar member. However, the assembling procedure is troublesome, as the extending portion of each handle must be extended through the associated slot. Further, use of the cap for retaining the handle is inconvenient to the user. Further, the engaging portion of each handle must be completely received in the associated slot of the bar member such that the bar member per se must have a considerable length to allow the user to grip the ends of the bar member, leading to adverse effect to storage and carriage. Although the bar member may be comprised of two members that can be detachably coupled together for the purposes of compact storage and easy carriage, an additional assembling procedure is required.

BRIEF SUMMARY OF THE INVENTION

In accordance with an aspect of the present invention, an exercise device comprises an elastic member, a bar, and a handle. The bar comprises an end including an engaging hole. The end of the bar further includes at least one longitudinal slot. The bar further comprises at least one transverse slot extending from an inner end of the at least one longitudinal slot.

The handle is coupled to an end of the elastic member. The handle comprises a grip portion and a connecting portion. The connecting portion includes at least one protrusion. The connecting portion of the handle is releasably coupled with the engaging hole of the end of the bar, with the at least one protrusion moving along the at least one longitudinal slot and the at least one transverse slot.

Preferably, the other end of the bar comprises an engaging hole. The other end of the bar further comprises at least one longitudinal slot having an inner end. The bar further comprises at least one transverse slot extending from the inner end of the at least one longitudinal slot of the other end of the bar. The other handle is coupled to the other end of the elastic member. The other handle also comprises a grip portion and a connecting portion. The connecting portion of the other handle includes at least one protrusion. The connecting portion of the other handle is releasably coupled with the engaging hole of the other end of the bar, with the at least one protrusion of the other handle moving along the at least one longitudinal slot and the at least one transverse slot of the other end of the bar.

Preferably, the connecting portion of the handle comprises two diametrically opposed protrusions.

Preferably, the protrusions of the handle are two exposed portions of a pin transversely extending through the connecting portion of the handle.

Preferably, the connecting portion of the other handle comprises two diametrically opposed protrusions.

Preferably, the protrusions of the other handle are two exposed portions of a pin transversely extending through the connecting portion of the other handle.

Preferably, the handle comprises a longitudinal through-hole. The handle further comprises two spaced flanges between the grip portion and the connecting portion. A slot is defined in a circumferential wall between the flanges. The handle further comprises an attachment member extending through the longitudinal through-hole and the slot of the handle.

Preferably, the end of the elastic member comprises an end piece coupled thereto. The end piece comprises a loop portion. A hook is mounted to the attachment member and includes a hook portion for coupling with the loop portion of the end piece.

Preferably, the other handle comprises a longitudinal through-hole.

The other handle further comprises two spaced flanges between the grip portion and the connecting portion of the other handle. A slot is defined in a circumferential wall between the flanges. The other handle further comprises an attachment member extending through the longitudinal through-hole and the slot of the other handle.

Preferably, the other end of the elastic member comprises an end piece coupled thereto. The end piece comprises a loop portion. A hook is mounted to the attachment member and includes a hook portion for coupling with the loop portion of the end piece.

Preferably, a protective padding member is mounted around the grip portion of the handle.

Preferably, a protective padding member is mounted around the grip portion of the other handle.

Preferably, the longitudinal guiding slot of the handle has a length the same as a distance between the at least one protrusion and one of the flanges of the handle adjacent to the at least one protrusion.

Preferably, the longitudinal guiding slot of the other handle has a length the same as a distance between the at least one protrusion and one of the flanges of the other handle adjacent to the at least one protrusion.

Preferably, the engaging hole of the end of the bar is an end of a longitudinal through-hole extending through the bar.

Preferably, the bar comprises a longitudinal through-hole having two ends respectively forming the engaging holes of the bar.

Preferably, the at least one longitudinal slot on the end of the bar extends inward from an end face of the end of the bar.

Preferably, the at least one longitudinal slot on the other end of the bar extends inward from an end face of the other end of the bar.

In accordance with another aspect of the invention, an exercise device comprises an elastic member, a bar comprising an end including an engaging hole, and a handle coupled to an end of the elastic member. The handle comprises a grip portion and a connecting portion. One of the end of the bar and the connecting portion of the handle includes at least one longitudinal slot extending longitudinally inward and at least one transverse slot extending from an inner end of the at least one longitudinal slot. The other of the end of the bar and the connecting portion of the handle includes at least one protrusion. The connecting portion of the handle is releasably coupled with the engaging hole of the end of the bar, with the at least one protrusion moving along the at least one longitudinal slot and the at least one transverse slot.

Other objectives, advantages, and novel features of the invention will become more apparent from the following detailed description when taken in conjunction with the accompanying drawings.

DETAILED DESCRIPTION OF THE INVENTION

Figure 1:
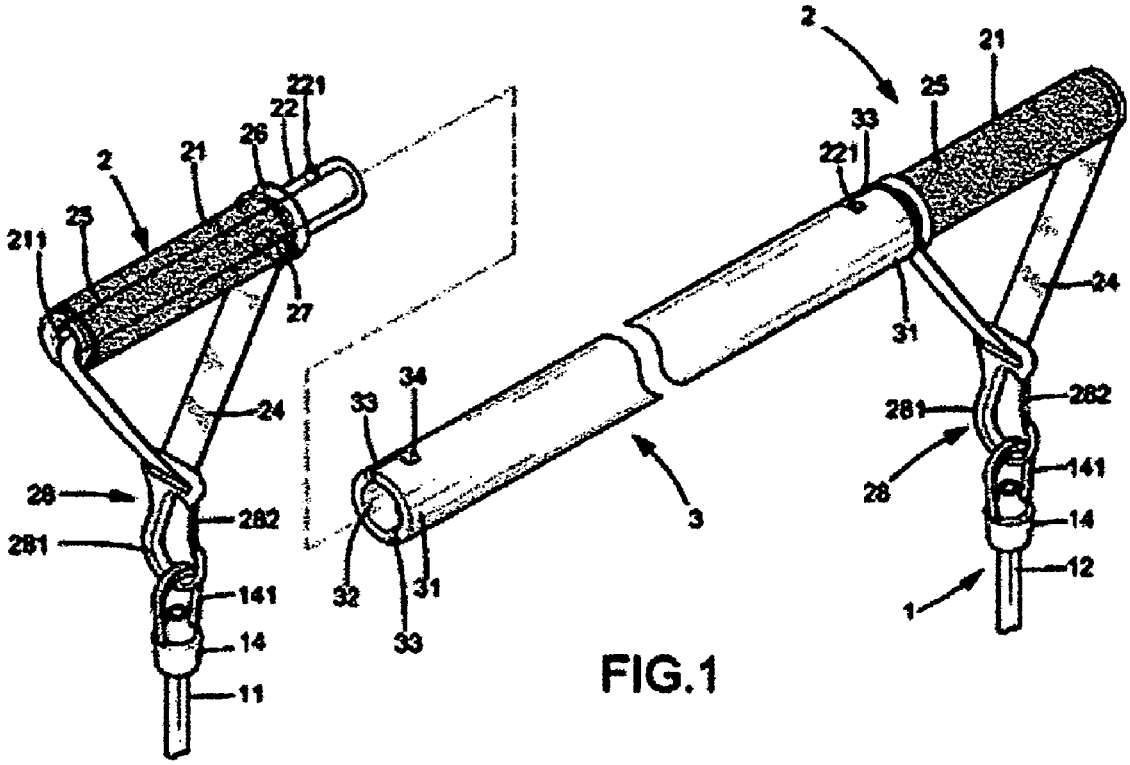
FIG. 1 is a perspective view, partly exploded, of an exercise device in accordance with the present invention.
Figure 2:
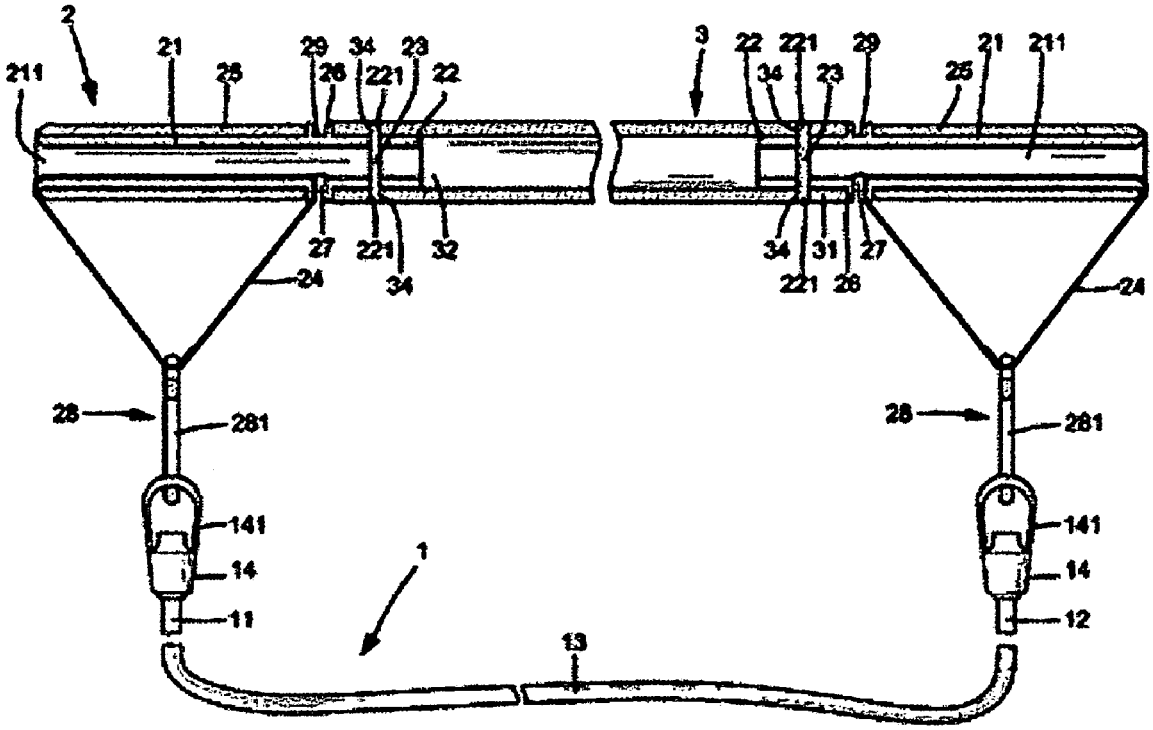
FIG. 2 is a sectional view of the exercise device in accordance with the present invention.

Referring to FIGS. 1 and 2, an exercise device in accordance with the present invention comprises a bar 3, an elastic member 1, and at least one handle 2 (two in this embodiment). The elastic member 1 is stretchable and has an appropriate length. The elastic member 1 comprises a first end 11, a second end 12, and an intermediate section 13. An end piece 14 is coupled to each end 11, 12 of the elastic member 1 and has an outer diameter greater than that of the elastic member 1. Each end piece 14 comprises a loop portion 141.

Each handle 2 is coupled to an associated end 11, 12 of the elastic member 1. Each handle 2 is tubular and includes a longitudinal through-hole 211. Each handle 2 further comprises a grip portion 21 and a connecting portion 22 having at least one protrusion 221. In the illustrated embodiment, the connecting portion 22 includes two diametrically opposed protrusions 221 formed by two exposed portions of a pin 23 that transversely extends through the connecting portion 22. Each handle 2 further includes two spaced flanges 26 between the grip portion 21 and the connecting portion 22. A slot 27 is defined in a circumferential wall 29 between the flanges 26. A protective padding member 25 may be mounted around the grip portion 21 for comfort gripping.

Figure 3:
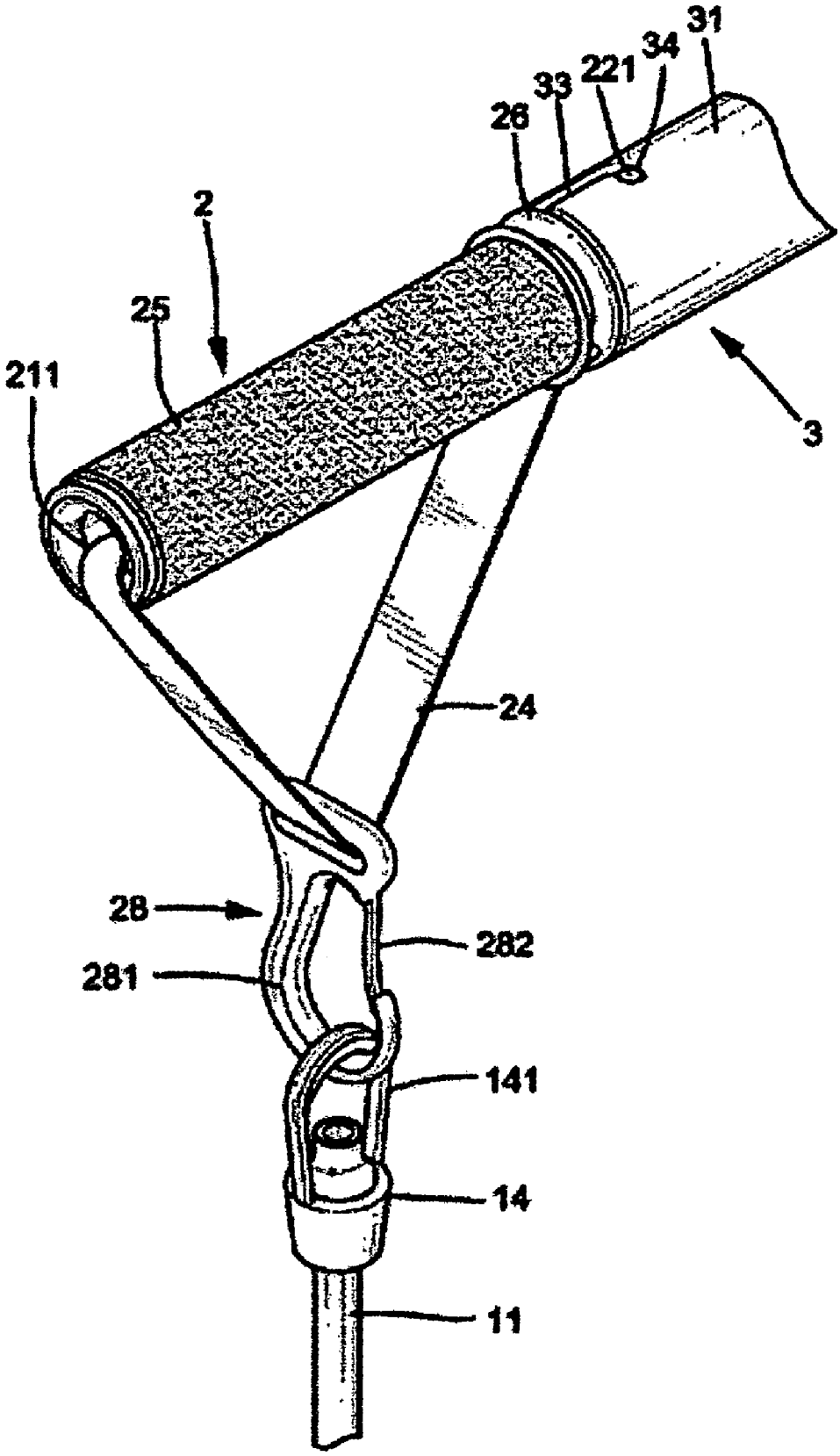
FIG. 3 is a perspective view of a portion of the exercise device in accordance with the present invention.

Each handle 2 further comprises an attachment member 24 for releasable coupling with the elastic member 1. As illustrated in FIG. 2, the attachment member 24 is a loop having a portion extending through the longitudinal through-hole 211 and the slot 27 of an associated handle 2. Referring to FIGS. 1 through 3, a hook 28 is attached to each attachment member 24 and includes a hook portion 281 and a resilient plate 282 for closing an opening (not labeled) of the hook portion 281. The loop portion 141 of each end piece 14 can be releasably engaged with the hook portion 281 of the associated hook 28, allowing easy assembling and disassembling.

The bar 3 has a length suitable for gripping by a user after the handles 2 are attached to two ends 31 of the bar 3. At least one end 31 of the bar 3 includes an engaging hole 32 for coupling with a handle 2. In this embodiment, each end 31 of the bar 3 includes an engaging hole 32 for coupling with an associated handle 2. Each engaging hole 32 may be an annular recess in an end face of the associated end 31 of the bar 3. Alternatively, the bar 3 includes a longitudinal through-hole (not labeled), with two ends of the longitudinal through-hole of the bar 3 respectively forming the engaging holes 32.

Each end 31 of the bar 3 comprises at least one longitudinal guiding slot 33 extending longitudinally inward from an end face of the end 31 and at least one transverse positioning slot 34 extending from an inner end of the longitudinal guiding slot 33. Each of the longitudinal guiding slot 33 and the transverse positioning slot 34 has a width allowing passage of the protrusion 221 of the associated handle 22. In this embodiment, each end 31 of the bar 3 comprises two diametrically opposed longitudinal guiding slot 33 and two diametrically opposed transverse positioning slot 34 respectively extending from inner ends of the longitudinal guiding slots 34.

Figure 4:
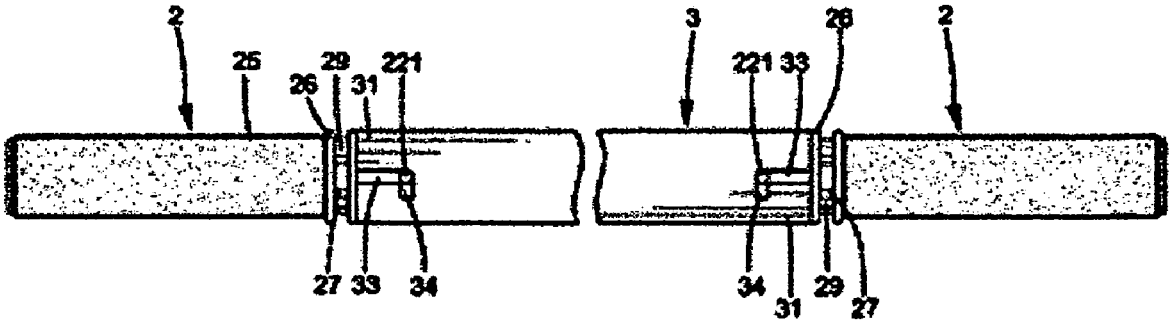
FIG. 4 is an elevational view of the exercise device in accordance with the present invention, illustrating assembling of the exercise device.
Figure 5:
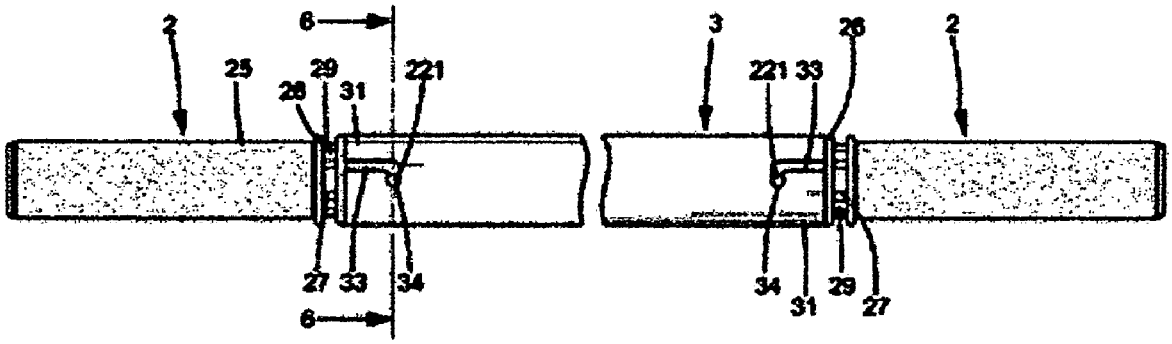
FIG. 5 is a view similar to FIG. 4, wherein the exercise device is in an assembled state.
Figure 6:
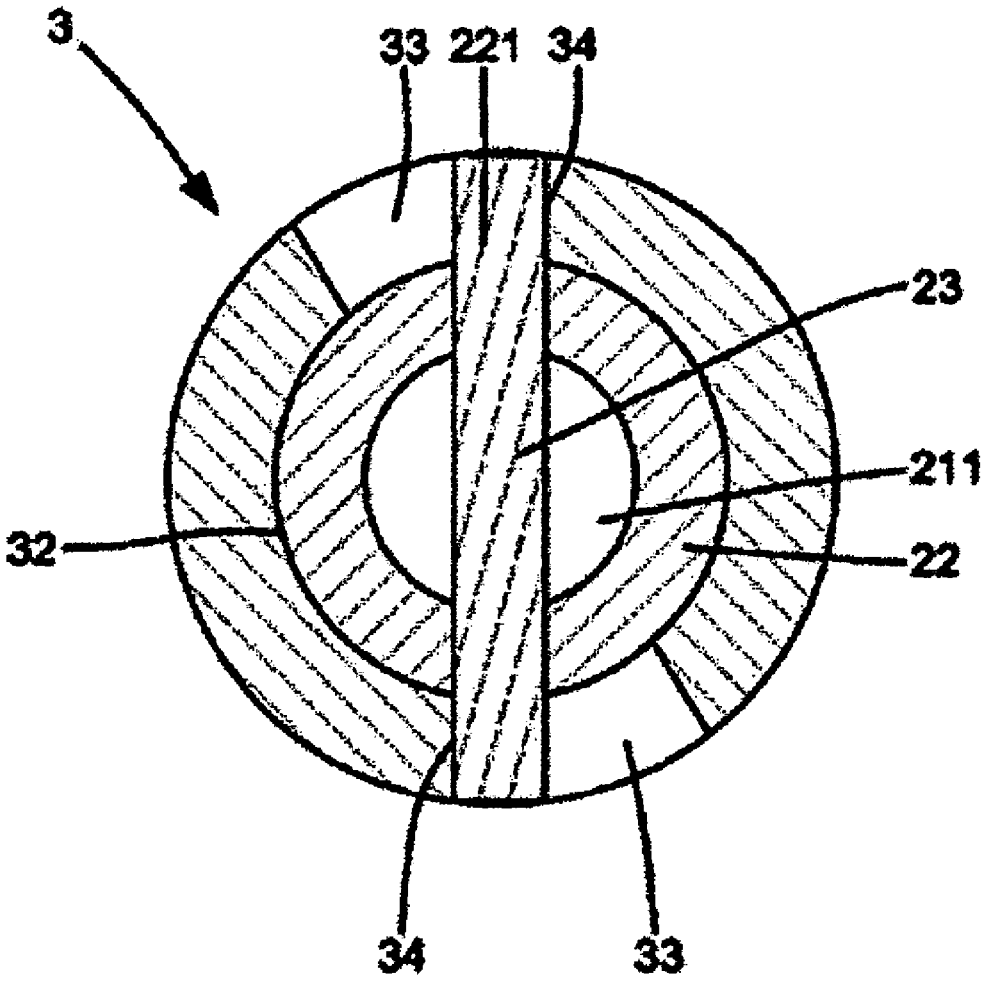
FIG. 6 is a sectional view taken along plane 6-6 in FIG. 5.

The length of each longitudinal guiding slot 33 is equal to the distance between an associated protrusion 221 and an adjacent flange 26 of an associated handle 2. Thus, when the connecting portion 22 of each handle 2 is inserted into an associated end 31 of the bar 3, the protrusions 221 reach the inner ends of the longitudinal guiding slots 33 of the associated end 31 when the inner flange 26 adjacent to the protrusions 221 comes in contact with the end face of the associated end 31 of the bar 3, as shown in FIG. 4. Each handle 2 is then turned along a circumferential direction, with each protrusion 221 moving along the associated transverse positioning slot 34 of the associated end 31 of the bar 3 to a position shown in FIGS. 5 and 6. Disengagement of the handles 2 from the bar 3 is, thus, prevented. Disassembling of the handles 2 can be easily accomplished by reverse operation of the handles 2. Namely, assembling and disassembling of the handles 2 are easy to the user.

In an alternative design, the protrusions 221 can be formed on the ends 31 of the bar 3 whereas the longitudinal guiding slots 33 and the transverse positioning slots 34 can be defined in the connecting portions 22 of the handles 2.

In use, a user positions an intermediate portion of the elastic member 1 with one or two feet to retain the elastic member 1 in position. Next, the user grips the grip portions 21 of the handles 2 and repeatedly raises the bar 3 to the chest or head level for exercising the muscles of the chest and the arms. The user may replace the elastic member 1 with another having a different elastic coefficient and/or different length. The overall length of the bar 3 is smaller than that of the conventional designs, as the bandies 2 can be deemed as extension of the ends 31 of the bar 3. Easy carriage and compact storage are, thus, provided.

Although specific embodiments have been illustrated and described, numerous modifications and variations are still possible without departing from the essence of the invention. The scope of the invention is limited by the accompanying claims.

What is claimed is:

1. An exercise device comprising:

an elastic member;

a bar comprising an end including an engaging hole, with the end of the bar further including at least one longitudinal guiding slot having an inner end, with the bar further comprising at least one transverse slot extending from the inner end of said at least one longitudinal guiding slot; and a handle coupled to an end of the elastic member, with the handle comprising a grip portion and a connecting portion, with the connecting portion including at least one protrusion;

with the connecting portion of the handle being releasably coupled with the engaging hole of the end of the bar by moving said at least one protrusion along said at least one longitudinal slot and said at least one transverse slot;

with the bar comprising another end including an engaging hole, with said another end of the bar further comprising at least one longitudinal guiding slot having an inner end, with the bar further comprising at least one transverse slot extending from the inner end of said at least one longitudinal guiding slot of said another end of the bar, with the exercise device further comprising another handle coupled to another end of the elastic member, with said another handle comprising a grip portion and a connecting portion, with the connecting portion of said another handle including at least one protrusion, and with the connecting portion of said another handle being releasably coupled with the engaging hole of said another end of the bar by moving said at least one protrusion of said another handle along said at least one longitudinal guiding slot and said at least one transverse slot of said another end of the bar.

2. The exercise device as claimed in claim 1, with said at least one protrusion of the connecting portion of said another handle comprising two diametrically opposed protrusions.

3. The exercise device as claimed in claim 2, with the protrusions of said another handle being two exposed portions of a pin transversely extending through the connecting portion of said another handle.

4. The exercise device as claimed in claim 1, with said another handle comprising a longitudinal through-hole, with said another handle further comprising two spaced flanges between the grip portion and the connecting portion of said another handle, with a slot being defined in a circumferential wall between the flanges, and with said another handle further comprising an attachment member extending through the longitudinal through-hole and the slot of said another handle.

5. The exercise device as claimed in claim 4, with said longitudinal guiding slot of said another handle having a length the same as a distance between said at least one protrusion and one of the flanges of said another handle adjacent to said at least one protrusion.

6. The exercise device as claimed in claim 4, with said another end of the elastic member comprising an end piece coupled thereto, with the end piece comprising a loop portion, and with a hook being mounted to the attachment member and including a hook portion for coupling with the loop portion of the end piece.

7. The exercise device as claimed in claim 1, with the exercise device further comprising a protective padding member mounted around the grip portion of the handle.

8. The exercise device as claimed in claim 1, with the exercise device further comprising a protective padding member mounted around the grip portion of said another handle.

9. The exercise device as claimed in claim 1, with the engaging hole of the end of the bar being an end of a longitudinal through-hole extending through the bar.

10. The exercise device as claimed in claim 1, with the bar comprising a longitudinal through-hole having two ends respectively forming the engaging holes of the bar.

11. The exercise device as claimed in claim 1, with said at least one longitudinal guiding slot on the end of the bar extending longitudinally inward from an end face of the end of the bar.

12. The exercise device as claimed in claim 1, with said at least one longitudinal guiding slot on said another end of the bar extending longitudinally inward from an end face of said another end of the bar.

13. An exercise device comprising:

an elastic member;

a bar comprising an end including an engaging hole, with the end of the bar further including two diametrically opposed longitudinal guiding slots each having an inner end, with the bar further comprising a transverse slot extending from the inner end of each of the longitudinal guiding slots; and a handle coupled to an end of the elastic member, with the handle including a grip portion and a connecting portion, with the connecting portion including two diametrically opposed protrusions, with the protrusions of the handle being two exposed portions of a pin transversely extending through the connecting portion of the handle, with the connecting portion of the handle being releasably coupled with the engaging hole of the end of the bar by moving each of the protrusions along one of the longitudinal guiding slots and one of the transverse slots.

14. An exercise device comprising:

an elastic member;

a bar comprising an end including an engaging hole, with the end of the bar further including at least one longitudinal guiding slot having an inner end, with the bar further comprising at least one transverse slot extending from the inner end of said at least one longitudinal guiding slot; and a handle coupled to an end of the elastic member, with the handle comprising a grip portion and a connecting portion, the connecting portion including at least one protrusion, with the connecting portion of the handle being releasably coupled with the engaging hole of the end of the bar by moving said at least one protrusion along said at least one longitudinal guiding slot and said at least one transverse slot, with the handle comprising a longitudinal through-hole, with the handle further comprising two spaced flanges between the grip portion and the connecting portion, with a slot being defined in a circumferential wall between the flanges, and with the handle further comprising an attachment member extending through the longitudinal through-hole and the slot of the handle.

15. The exercise device as claimed in claim 14, with the end of the elastic member comprising an end piece coupled thereto, with the end piece comprising a loop portion, and with a hook being mounted to the attachment member and including a hook portion for coupling with the loop portion of the end piece.

16. The exercise device as claimed in claim 14, with said longitudinal guiding slot of the handle having a length the same as a distance between said at least one protrusion and one of the flanges of the handle adjacent to said at least one protrusion.

17. An exercise device comprising:

an elastic member;

a bar comprising an end including an engaging hole; and a handle coupled to an end of the elastic member, the handle comprising a grip portion and a connecting portion;

one of the end of the bar and the connecting portion of the handle including at least one longitudinal guiding slot extending longitudinally inward and at least one transverse slot extending from an inner end of said at least one longitudinal guiding slot;

with the other of the end of the bar and the connecting portion of the handle including at least one protrusion, with the connecting portion of the handle being releasably coupled with the engaging hole of the end of the bar by moving said at least one protrusion along said at least one longitudinal guiding slot and said at least one transverse slot, with the bar comprising another end including an engaging hole, the exercise device further comprising another handle coupled to another end of the elastic member, with said another handle comprising a grip portion and a connecting portion;

with one of said another end of the bar and the connecting portion of said another handle including at least one longitudinal guiding slot extending longitudinally inward and at least one transverse slot extending from an inner end of said at least one longitudinal guiding slot;

with the other of said another end of the bar and the connecting portion of said another handle including at least one protrusion; and with the connecting portion of said another handle being releasably coupled with the engaging hole of said another end of the bar by moving said at least one protrusion along said at least one longitudinal guiding slot and said at least one transverse slot.

* * * * *